US005433839A

United States Patent [19]

Amelot et al.

[11] Patent Number: 5,433,839

[45] Date of Patent: Jul. 18, 1995

[54] PROCESS FOR THE MANUFACTURE OF A COATED STAINLESS STEEL SHEET

[75] Inventors: Pascal Amelot, Bethune; Jean-Claude Bavay, Isebergues, both of France

[73] Assignee: Ugine S.A., Puteaux, France

[21] Appl. No.: 74,614

[22] Filed: Jun. 11, 1993

[30] Foreign Application Priority Data

Jun. 12, 1992 [FR] France ..... 92 07120

[51] Int. Cl.[6] ..... C25D 5/36; C25D 5/50

[52] U.S. Cl. ..... 205/154; 205/218; 205/226; 205/228

[58] Field of Search ..... 205/140, 154, 218, 219, 205/225, 226, 228

[56] References Cited

U.S. PATENT DOCUMENTS

| | | | |
|---|---|---|---|
| 1,776,603 | 9/1930 | Schulte | 205/218 |
| 2,973,307 | 2/1961 | Hahn | 205/218 |
| 4,764,260 | 8/1988 | Gay et al. | 205/178 |

FOREIGN PATENT DOCUMENTS 0080971 6/1983 European Pat. Off. .

OTHER PUBLICATIONS

F. A. Lowenheim, *Electroplating,* McGraw-Hill Book Co., New York, 1978, pp. 67-89, 306-319.

Metal Finishing Guidebook and Directory for 1978, Metals and Plastics Publications, Inc., Hackensack, N.J., pp. 155-159 and 293-313.

Verlag Stahlschlussel Wegst GmbH, 1989, pp. 374-375, A. C. W. Wegst, "Stahlschlussel".

Chemical Abstracts, vol. 102, No. 2, Jan. 1985, Columbus, Ohio, US; abstract No. 14113a, "Pretreatment for Plating Stainless Steels" p. 488 (Abstract) & JP-A-59 145 795 (Furukawa Electric Co., Ltd) 21 Aug. 1984.

Patent Abstracts of Japan vol. 14, No. 299 (C-733)(4242) 27 Jun. 1990 & JP-A-29 7 695 (Kawasaki Steel Corporation) 10 Apr. 1990 (Abstract).

Patent Abstract of Japan vol. 11, No. 176 (C-426)(2623) 5 Jun. 1987 & JP-A-62 1 896 (Masami Kobayashi) 7 Jan. 1987 (Abstract).

*Primary Examiner*—John Niebling

*Assistant Examiner*—William T. Leader

*Attorney, Agent, or Firm*—Oblon, Spivak, McClelland, Maier & Neustadt

[57] ABSTRACT

This sheet metal comprises a substrate (12) made of stainless steel containing more than 16% of chromium in its weight composition, coated with a metal layer (16) containing chiefly tin. Between the metal layer (16) and the substrate (12) the sheet metal comprises a layer (14) of an intermetallic compound containing at least iron, chromium and tin. To manufacture this sheet metal, a layer (16) of metallic coating containing chiefly tin is deposited by an electrolytic route on a sheet (12) made of stainless steel. The coated sheet metal is heated to a temperature above the melting temperature of the coating layer (16) to permit the formation of the intermetallic compound. The heating is maintained for a sufficient period for the surface of the coating layer (16) to have a matt appearance.

16 Claims, 2 Drawing Sheets

PROCESS FOR THE MANUFACTURE OF A COATED STAINLESS STEEL SHEET

The present invention relates to a coated sheet metal and to a process for the manufacture of this sheet metal.

It applies in particular to the manufacture of roofs of buildings.

Stainless steel sheets coated with a lead-rich alloy are already known in the state of the art. The coating of a stainless steel sheet with lead is generally carried out on lines for continuous treatment of reels by immersion in a bath of molten lead-based alloy. The lead-based alloy generally contains tin to facilitate the wetting and adherence of the coating.

These coated sheets are applied for the roofing of buildings because they incorporate many advantages. In particular, they have good resistance to inclement weather and good suitability for soft soldering. Also needing to be mentioned is their light weight (approximately 3 kg/m$^2$ at a sheet metal thickness of 0.4 mm), good mechanical strength and, in the case of sheets made of ferritic stainless steel, a low coefficient of linear expansion which makes it possible to obtain an elongation of 1.06 mm/m with a change of 100° C., whereas in the case of zinc sheets an elongation of 2.20 mm/m is obtained with a change of 100° C.

A roof constructed in ferritic stainless steel sheets containing 17 mass % of chromium and coated with a layer of lead-based alloy has an excellent resistance to atmospheric corrosion agents such as acidic rain and the precipitation of fuel oil fumes.

In some particularly corrosive atmospheres, for example at the seaside and/or near industries with corrosive discharges, use is preferably made of sheet metal coated with alloyed stainless steel containing molybdenum in a mass concentration of 1 to 3%.

In contact with the atmosphere lead-coated sheets gradually become covered with a protective film whose matt grey appearance resembles that of "old tin". However, this patina—valued by architects—develops slowly. Its formation, which can take a number of months, is preceded by a transitional stage during which exposure to inclement weather results in the appearance of unsightly lead corrosion products. During this transitional stage rain water causes a partial solubilization of the lead, which has the effect of spreading harmful lead-based compounds into the environment.

The aim of the present invention is to provide sheet metal which can be employed as roofing material which does not have the harmful effects and the unsightly aspects inherent in coatings containing lead, these sheets having an aesthetic matt appearance and good solderability and being protected against atmospheric corrosion.

To this end, the subject of the invention is a process for the manufacture of coated sheet metal employed especially for the manufacture of roofs of buildings, characterized in that a layer of metallic coating of pure tin or of a tin alloy in which the alloying element is chosen especially from zinc and nickel is deposited electrolytically on at least one of the faces of a stainless steel sheet containing more than 16% of chromium in its weight composition.

In accordance with the characteristics of different embodiments of the invention:

the coated sheet metal is heated to a temperature higher than or equal to the melting temperature of the tin-based coating layer in order, on the one hand, to form a layer of intermetallic compound between the sheet metal and the metallic coating comprising at least tin and an element forming part of the composition of the stainless steel sheet and, on the other hand, to impart a matt appearance to the surface of the coating;

the heating temperature is lower than 500° C.;

the sheet metal is degreased before the deposition of the coating layer;

the sheet metal is degreased by a chemical route by employing a bath containing organic solvents or else by employing a bath containing alkaline mixtures;

the bath contains an organic solvent chosen from methylene chloride, 1,1,1-trichloroethane, perchloroethylene and trichloroethylene;

the bath contains an alkaline mixture comprising at least one compound chosen from sodium hydroxide, sodium carbonate, sodium metasilicate, phosphates and complexing agents;

the sheet metal is degreased electrolytically by employing an alkaline electrolyte and by alternating or not alternating the polarities;

the electrolyte comprises an alkaline compound in a proportion of 0.5 to 20 mass %, the electrolyte being at a temperature of between 20 and 95° C., the sheet metal being subjected to a current density of between 0.1 and 20 A/dm$^2$ for a period longer than 0.1 s;

the electrolyte comprises an alkaline compound chosen from sodium hydroxide and potassium hydroxide;

the electrolyte additionally comprises a compound chosen from calcium carbonate, sodium metasilicate, phosphates, complexing agents and surface-active agents;

the sheet metal is subjected to a neutral aqueous rinsing after it has been degreased;

after the degreasing or the rinsing following this degreasing the sheet metal is pickled;

the sheet metal is pickled chemically by being immersed in a bath containing an inorganic acid, the mass proportion of the acid being in a range from 0.2 to 50%;

the inorganic acid is chosen from sulfuric acid and hydrochloric acid;

the bath contains 0.2 to 40 mass % of hydrochloric acid and is at a temperature of between 20 and 95° C., the immersion period of the sheet metal in the bath being longer than 0.1 s;

the sheet metal is pickled electrolytically in an electrolyte bath containing an inorganic acid, the mass proportion of the acid being in a range from 0.2 to 50%;

the acid of the electrolyte bath is chosen from sulfuric acid and hydrochloric acid;

the electrolyte bath contains 1 to 50 mass % of sulfuric acid and is at a temperature of between 20° and 95° C. the sheet metal being subjected to a current density of between 0.1 and 50 A/dm$^2$, the period of immersion of the sheet metal in the bath being longer than 0.1 s;

while being pickled the sheet metal is subjected either to an alternately cathodic and anodic polarization, the treatment being completed with cathodic polarization, or to a continuous cathodic polarization;

the sheet metal is subjected to a rinsing after being pickled;

the sheet metal is activated before the deposition of the layer of metallic coating;

the sheet metal is activated by a chemical route;

the sheet metal is activated by being immersed in a bath containing an acid chosen from sulfuric, hydrochloric, hydrofluoric, boric, fluoroboric, phenolsulfonic and cresolsulfonic acids, the bath having a pH lower than the pH for depassivation of the sheet metal;

the bath is at a temperature of more than 15° C. and the immersion period of the sheet metal in the bath is longer than 0.1 s;

the sheet metal is activated electrolytically;

the sheet metal is activated by employing an acidic electrolyte bath containing an acid chosen from hydrochloric, phosphoric, sulfuric, hydrofluoric, boric, fluoroboric, phenolsulfonic and cresolsulfonic acids, the bath having a pH lower than 1;

the electrolyte bath is at a temperature of more than 15° C. and the sheet metal is subjected to a cathodic polarization with a current density of between 0.1 to 50 A/dm$^2$ the immersion period of the sheet metal in the bath being longer than 0.1 s;

the electrolyte bath additionally comprises stannous ions in a concentration of between 0.1 and mass %;

a layer of coating comprising pure tin is deposited on the sheet metal;

the electrolytic deposition bath contains stannous tin and phenolsulfonic acid;

the electrolytic deposition bath contains stannous tin in a proportion within the range [20–40] g/l and phenolsulfonic acid in a proportion within the range [20–40] g/l, the current density being higher than 1 A/dm$^2$ and the temperature of the bath being higher than 15° C.;

the electrolytic deposition bath contains stannous chlorides and alkali metal chlorides and fluorides;

the electrolytic deposition bath contains stannous chloride $SnCl_2.2H_2O$ in a proportion within the range [30–90] g/l, sodium fluoride NaF in a proportion within the range [40–60] g/l and sodium chloride NaCl in a proportion within the range [40–60] g/l, the current density being higher than 1 A/dm$^2$ and the temperature of the bath being higher than 15° C.;

the electrolytic deposition bath contains stannous tin and boric and fluoroboric acids;

the electrolytic deposition bath contains stannous tin in a proportion within the range [40–80] g/l, fluoroboric acid in a proportion within the range [40–200] g/l, and boric acid in a proportion within the range [10–30] g/l, the current density being higher than 1 A/dm$^2$ and the temperature of the bath being higher than 15° C.;

a layer of coating comprising an alloy of tin and zinc the weight composition of which is the following:

$Sn > 60\%$ $Zn < 40\%$ or an alloy of tin and nickel the weight composition of which is the following:

$Sn > 80\%$ $Ni < 20\%$ is deposited on the sheet metal.

Another subject of the invention is a coated sheet metal characterized in that it comprises a substrate made of stainless steel containing more than 16% of chromium in its weight composition, covered on at least one of its faces with a layer of metallic coating of pure tin or of a tin alloy in which the alloying element is chosen especially from zinc and nickel.

In accordance with the characteristics of various embodiments of this sheet metal:

the layer of metallic coating has a thickness smaller than or equal to 30 μm, preferably equal to 3 μm;

between the substrate and the tin-based coating layer the sheet metal comprises a layer of intermetallic compound containing at least iron, chromium and tin;

the substrate is made of ferritic steel containing, on a mass basis, approximately 17% of chromium, less than 0.06% of carbon and less than 0.015% of sulfur and being capable of containing approximately 1.2% of molybdenum;

the substrate is made of austenitic steel containing, on a mass basis, approximately 18% of chromium, more than 6 % of nickel, less than 0.07% of carbon and less than 0.015% of sulfur and being capable of containing approximately 2.2% of molybdenum;

the substrate is made of ferritic steel, containing, on a mass basis, from 17 to 25% of chromium and from 0.2 to 2% of nickel.

The description which follows and the attached figures—the whole being given by way of nonlimiting examples—will make the invention properly understood:

Figure 1:
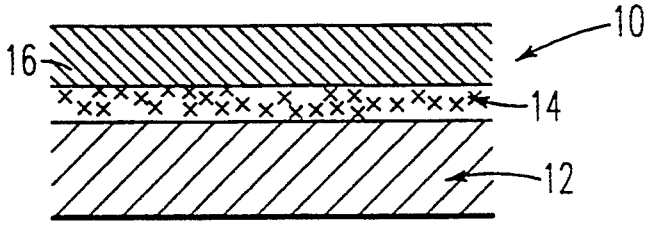
FIG. 1 is a diagrammatic sectional view of a sheet metal according to the invention.

A coated sheet metal according to the invention, indicated by the general reference 10 can be seen in FIG. 1. This sheet metal 10 comprises a substrate consisting of a sheet 12 made of stainless steel containing more than 16% of chromium in its weight composition. On one of its faces this sheet 12 comprises a layer 14 of intermetallic compound containing at least iron, tin and chromium (Fe—Sn—Cr) and a layer 16 of metallic coating, containing chiefly tin, covering the layer 14 of intermetallic compound.

The steels employed for the manufacture of the sheet 12 are of two types. A first type corresponds to ferritic grades which contain 17% of chromium (Cr) with or without molybdenum (Mo) referred to according to the US Standard as AISI 430, AISI 434, AISI 439 and AISI 444, and the French Standard as Z3CTNb18. A second type corresponds to austenitic grades which contain 18% of chromium and at least 6% of nickel (Ni) with or without molybdenum, referred to according to the US Standard as AISI 304 and AISI 316.

The corrosion resistance of stainless steels is proportionately higher the higher the contents of alloy elements Cr, Ni and Mo.

The steel grades employed in the examples described are detailed in the table below.

| Grade | Cr % | Ni % | Mo % | Ti max % | Nb max % | C max % | S max % |
|---|---|---|---|---|---|---|---|
| AISI 430 | 17 | | | | | 0.06 | 0.015 |
| AISI 434 | 17 | | 1.2 | | | 0.06 | 0.01 |
| AISI 439 | 17 | | | 0.5 | | 0.02 | 0.005 |
| AISI 444 | 18.5 | | 2.1 | 0.6 | 0.5 | 0.025 | 0.015 |
| Z3CTNb18 | 17.8 | | | 0.5 | 0.9 | 0.03 | 0.005 |
| AISI 304 | 18 | 6.2 | | | | 0.07 | 0.015 |
| AISI 316 | 18 | 11 | 2.2 | | | 0.07 | 0.015 |

Other stainless steels can be employed, provided that they contain at least 16 mass % of chromium. It is possible, for example, to employ a ferritic steel sheet 12 containing, on a mass basis, from 17 to 25% of chromium and from 0.2 to 2% of nickel.

Figure 2:
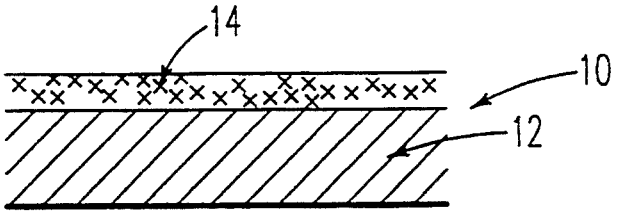
FIG. 2 is a diagrammatic sectional view of the sheet metal of FIG. 1, the metallic coating layer containing chiefly tin having been dissolved in contact with air and inclement weather.

When the sheet metal 10 is placed in the open air and is subjected to inclement weather, the layer 16 can be dissolved after a prolonged period of use over a number of years. In this case a sheet metal 10 as shown in FIG. 2 is obtained, the coated face of which now comprises only the layer 14 of intermetallic compound.

The coated sheet metal 10 is manufactured by a process which will be described below.

The stages of surface treatment of a stainless sheet metal 12 manufactured with a steel from the grades defined in the table above will be described first of all, and then the deposition of a layer of pure tin on this stainless sheet metal.

In a first step the surface of the stainless steel sheet is degreased.

The degreasing operation is recommended to guarantee a good adherence of the tin coating. In fact, if the surface of the stainless steel is not degreased, the fatty substances and other surface contaminants which are not removed are liable to reduce the adherence of the tin deposit and to give rise to a nonhomogeneous deposit comprising areas without coating.

The degreasing of the sheet metal can be performed either chemically or electrolytically.

The sheet metal can be degreased chemically by being placed in contact with a solution containing halogenated organic solvents such as methylene chloride, 1,1,1-trichloroethane, perchloroethylene or trichloroethylene. The sheet metal can also be degreased chemically by employing a solution based on alkaline mixtures containing especially sodium hydroxide, sodium carbonate, sodium metasilicate, phosphates, complexing agents and surface-active agents.

The degreasing operation is preferably performed electrolytically in an electrolysis bath or electrolyte consisting of an aqueous solution containing alkaline mixtures similar to those just specified or else calcium carbonate or potassium hydroxide. In the examples described the electrolyte contains 2 mass % of sodium hydroxide and is at a temperature of 90° C. The stainless sheet metal is immersed in the electrolyte for 20 seconds at an intensity of 10 A/dm$^2$. According to a known process the polarities are reversed during electrolytic degreasing, following the cycle cathodic polarity/anodic polarity/cathodic polarity.

The operation of degreasing by an electrolytic route can be performed under other conditions. The electrolyte may contain an alkaline compound in a proportion of 0.5 to 20 mass %. The temperature of the electrolyte may be between 20° and 95° C. The sheet metal may be subjected to a current density of between 0.1 and 20 A/dm$^2$ for a period longer than 0.1 s.

The degreasing of the stainless steel sheet 12 is followed by a rinsing with water (neutral medium) in order not to contaminate the treatment baths which will be employed subsequently.

The stage of degreasing of the sheet metal 12 is preferably followed by a stage of pickling of the surface of the sheet metal.

The pickling of the stainless sheet metal is carried out chemically or electrolytically.

The sheet metal can be pickled chemically by being immersed in a bath containing an inorganic acid chosen from sulfuric and hydrochloric acids or other inorganic acids, the proportion of the acid on a mass basis being within a range from 0.2 to 50%. The stainless sheet metal is kept for at least 0.1 s in the bath, which is at a temperature of more than or equal to 20° C. The bath preferably contains 0.2 to 40 mass % of hydrochloric acid and is at temperature of between 20° and 50° C.

The concentration of the acid in the pickling bath is defined so as to impose a bath pH which is lower than the pH for depassivation of the stainless steel to be treated at the temperature of the bath.

The pickling operation is preferably performed electrolytically in an electrolysis bath or electrolyte consisting of an aqueous solution containing an inorganic acid chosen from sulfuric and hydrochloric acids or other inorganic acids, in a proportion of 0.2 to 50 mass %. The acid is at a concentration such that the pH of the solution is lower than 1 at the temperature of the bath.

The sheet metal is preferably immersed in an electrolyte containing from 1 to 50 mass % of sulfuric acid which is at a temperature of between 20° and 95° C., the sheet metal being subjected to a current density of between 0.1 and 50 A/dm$^2$ the period of immersion of the sheet metal in the electrolyte being longer than 0.1 s.

The polarities may be alternately cathodic and anodic, the treatment being completed with cathodic polarization, or solely cathodic.

In the examples described the electrolyte contains 3 mass % of sulfuric acid and is at a temperature of 40° C. with a current density of 10 A/dm$^2$, with polarities which are successively cathodic, anodic and cathodic.

The pickling of the stainless steel sheet 12 is followed by a rinsing with water (neutral medium) in order not to contaminate the treatment baths which will be employed subsequently.

Sheets made of stainless steel containing more than 16% of chromium are of industrial surface quality—arising from their process of manufacture including pickling, cold rolling and annealing stages—which does not require any finishing such as, for example, mechanical or chemical polishing.

Before the deposition of the layer of tin or tin alloy on the stainless steel sheet 12 the sheet is activated.

In fact, stainless steels have a protective layer rich in chromium oxides and hydroxides, called a passive layer, on their surface. The aim of the activation is to remove this passive layer in order to obtain good adherence of the coating, for example of tin, without requiring any premetalizing of the surface of the sheet metal, such as nickel plating.

The activation is performed under conditions which are adapted to the grade of the stainless steel to be treated, it being known that the formation of the passive layer in air is proportionally faster the more resistant the stainless steel is to corrosion. This is especially the case with steels containing more than 16% of chromium in their weight composition, which require the use of nonpassivating acids to be activated. Consequently, an acid of nitric type cannot be suitable.

The activation of the stainless sheet metal is carried out chemically or electrolytically.

The sheet metal can be activated chemically by immersion in a bath containing one or a number of reducing acids such as hydrochloric acid, phosphoric acid, sulfuric acid, hydrofluoric, boric or fluoroboric acid, as well as phenolsulfonic and cresolsulfonic acids or other organic acids.

The stainless sheet metal is kept for at least 0.1 s in the bath, which is at a temperature of more than or equal to 15° C.

The concentration of the acid in the activating bath is defined so as to impose a bath pH which is lower than the pH for depassivation of the stainless steel to be treated at the temperature of the bath. The pH for depassivation is defined as being the limiting pH of the bath, below which the passive layer covering the stainless steel is no longer stable, this steel becoming vulnerable to corrosion.

In a first example an activation by a chemical route is carried out on a stainless steel sheet of AISI 430 type, before the deposition of a layer of tin, by immersing the sheet in a bath containing especially 9 mass % of hydrochloric acid. This bath is taken to a temperature of 20° C. and the sheet is kept in the bath for approximately 10 s.

The activation of the sheet metal by a chemical route can be performed under other conditions. The sheet metal may be immersed in a bath containing 0.2 to 40 mass % of hydrochloric acid. The temperature of the bath may be between 15° and 95° C.

An activation may also be performed by an electrolytic route by employing an electrolysis bath or electrolyte similar to the bath employed for the activation by a chemical route, that is to say containing an acid chosen from hydrochloric, phosphoric, sulfuric, hydrofluoric, boric and fluoroboric acids and phenolsulfonic, cresolsulfonic or other organic acids, but with an acid concentration such that the pH of the bath is lower than 1.

Using an electrolytic route, the polarization of the bath is cathodic or else is alternately anodic and cathodic, the polarization being always cathodic at the end of activation. The current density employed is higher than 0.1 A/dm$^2$, preferably between 0.1 and 50 A/dm$^2$. The stainless sheet metal is kept for a period longer than 0.1 s in the bath, this bath being at a temperature of more than or equal to 15° C.

With alternating anodic/cathodic polarization it is preferable to employ a bath containing an acid whose anion is electrochemically inactive. Thus, sulfuric acid is employed in preference to hydrochloric acid to avoid any release of chlorine in an anodic phase. The treatment is completed with cathodic polarization to prevent any repassivation of the sheet metal capable of being initiated by an anodic polarization.

An activation can also be performed electrolytically by employing an acidic electrolyte chosen from the acids referred to above, in a concentration such that the pH of the bath is lower than 1, to which a quantity of stannous ions may be added in a concentration of between 0.1 and 3 mass %. The temperature of the electrolyte is higher than or equal to 15° C. The sheet metal is subjected to a cathodic polarization with a current density of between 0.1 and 50 A/dm$^2$. The period of immersion of the sheet metal in the electrolyte is longer than 0.1 s.

In a second example, the activation of a reel of stainless steel of AISI 430 type is carried out continuously by cathodic polarization at 10 A/dm$^2$, for 0.8 s, in an electrolyte containing 17 mass % of phenolsulfonic acid at a temperature of 20° C. In this example the anodes placed facing the strip are made of ferrosilicon alloy.

The activation of the reel of stainless steel of AISI 430 type can also be carried out under the same operating conditions as above, but with stainless steel anodes, for example: of AISI 316 type.

Under the operating conditions described in this first example the reel of stainless steel may be of AISI 439, AISI 434, AISI 304, AISI 444 or AISI 316 type or of Z3CTNb18 type.

In a third example an activation of stainless steel sheets of the AISI 434, AISI 304, AISI 316 and AISI 444 type is carried out electrolytically. In this example the activation of the stainless steel sheet is performed electrolytically by employing a bath containing 20 mass % of sulfuric acid. The sheet metal is kept for 20 s in the bath, the latter being at a temperature of 20° C. The current density is controlled at 10 A/dm$^2$. The polarities have been reversed during the electrolytic activation in accordance with the cathodic polarity/anodic polarity/cathodic polarity cycle.

In a fourth example the activation of a reel of AISI 316 type is carried out continuously by an electrolytic route.

The electrolyte contains 17 mass % of phenolsulfonic acid and 0.5 mass % of stannous ions, at a temperature of 20° C. The cathode current density is controlled at 10 A/dm$^2$. The anodes are made of alloy of ferrosilicon type and the immersion period is 0.8 s.

The operating conditions described in this example are also applicable to the stainless grades mentioned above.

When the stages of activation of the surface of the stainless steel sheet are completed, a layer of pure tin or of tin alloy is deposited electrolytically, without intermediate rinsing, to avoid any repassivation of the sheet metal.

Consequently care will be taken that the electrolyte employed for activating the sheet metal should be compatible with the electrolyte employed for depositing the layer of tin or tin alloy on the sheet metal.

A number of embodiments of a deposition of pure tin will be described below.

According to one embodiment of the deposition of pure tin, the electrolyte contains stannous ($Sn2+$) tin in the presence of phenolsulfonic acid or of boric and fluoroboric acid, or stannous chloride in the presence of alkali metal chlorides or fluorides. The current density applied to the sheet metal is higher than 1 A/dm$^2$ and the temperature of the electrolyte is more than 15° C.

In the case of the examples described the electrolyte contains a solution of stannous ($Sn2+$) tin in phenolsulfonic acid. The stannous tin content is from approximately 20 to 40 g/l and the phenolsulfonic acid content is between 20 and 40 g/l.

Additives are also added, such as βnaphthol (1 g/l) and gelatin (2 g/l). They make it possible to provide the coating with fineness, compactness and uniformity. The current density is between 10 and 35 A/dm$^2$, and the temperature of the bath between 25 and 40° C.

According to another embodiment of the deposition of pure tin, the deposition bath contains stannous chlorides and alkali metal chlorides and fluorides.

For example, the bath contains stannous chloride $SnCl_2.2H_2O$ in a proportion within the range [30–90] g/l, sodium fluoride NaF in a proportion within the range [40–60] g/l and sodium chloride NaCl in a proportion within the range [40–60] g/l. The bath is employed with a current density higher than 1 A/dm$^2$ and a temperature of more than 15° C.

According to yet another embodiment of the deposition of pure tin, the deposition bath contains stannous tin and boric and fluoroboric acids.

For example, the bath contains stannous tin in a proportion within the range [40–80] g/l, fluoroboric acid in a proportion within the range [40–200] g/l and boric acid in a proportion within the range [10–30] g/l. The bath is employed with a current density higher than 1 A/dm$^3$ and a temperature of more than 15° C.

The tin coating is of relatively low thickness. In the examples described the tin coating deposited has a thickness of 3 μm.

In other embodiments of the invention the thickness of the tin layer may reach 30 μm.

In this state the sheet metal has a matt surface appearance and forms a product which can be employed for the manufacture of roofs of buildings.

The tin-coated stainless sheet metal is next heated by known means, for example an induction oven, to a temperature which is higher than or equal to the melting temperature of tin (232° C).

In the examples described the temperature for heating the tin-coated sheet metal is 250° C.

The purpose of the heat treatment is to form an intermetallic compound containing at least iron, tin and chromium, at the interface of the stainless steel sheet and of the tin layer, while preserving the matt surface appearance of the tin layer.

When the tin coating changes into the molten state, its roughness is minimal. If the heat treatment is stopped just after the melting of the tin with the aid of rapid cooling, the surface appearance obtained is very shiny. To avoid this shine and to obtain a coating of matt appearance, the heat treatment is prolonged for a sufficient time which depends especially on the thickness of the tin layer. The intermetallic compound grows during the heating period, developing mechanical stresses in the tin layer which perturb the free surface of this layer and result in the return of a matt appearance. The heat treatment period must therefore be sufficiently long to allow the coating not to have a shiny appearance after cooling.

The heat treatment also contributes to reinforcing the adherence of the tin layer to the stainless sheet metal through the intermediacy of the intermetallic compound.

The presence of the intermetallic compound is demonstrated, for example by dissolving the tin layer at constant intensity in a solution of hydrochloric acid at a concentration of 1 mol/l.

Figure 3:
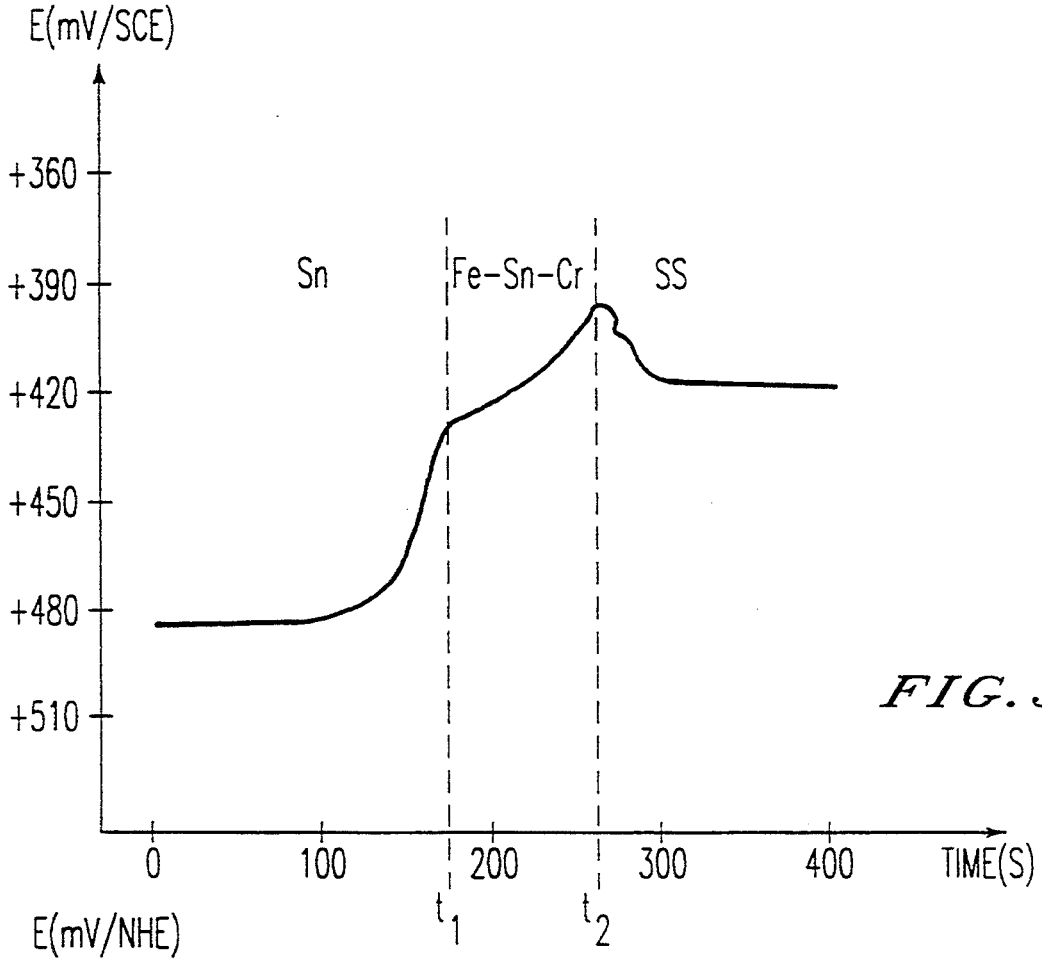
FIG. 3 is a diagram showing the change, as a function of time, in the dissolution potential of the coating of a sheet metal manufactured according to the invention.

FIG. 3 shows the curve of change in the dissolution potential of the tin layer as a function of time. The time t1 corresponds to the baring of the layer of intermetallic Fe—Sn—Cr compound and to the end of the dissolving of the layer of pure tin. The time t2 corresponds to the end of the dissolving of the layer of intermetallic Fe—Sn—Cr compound and to the baring of the stainless steel. The time t2−t1 is proportional to the thickness of the layer of intermetallic compound.

In the examples described the layer of intermetallic compound has a thickness of approximately 0.7 micrometer.

The elements constituting the intermetallic compound are identified, for example, by means of an electronic microprobe. The intermetallic compound may contain other elements in addition to iron, tin and chromium.

The layer of intermetallic compound is bared after several years in use when the sheet metal is exposed to the open air and subjected to inclement weather. The intermetallic compound which remains at the surface of the stainless steel sheet is of a dark grey color, resembling that of "old tin".

The layer of intermetallic compound has a corrosion resistance which is greatly superior to that of tin.

Figure 4:
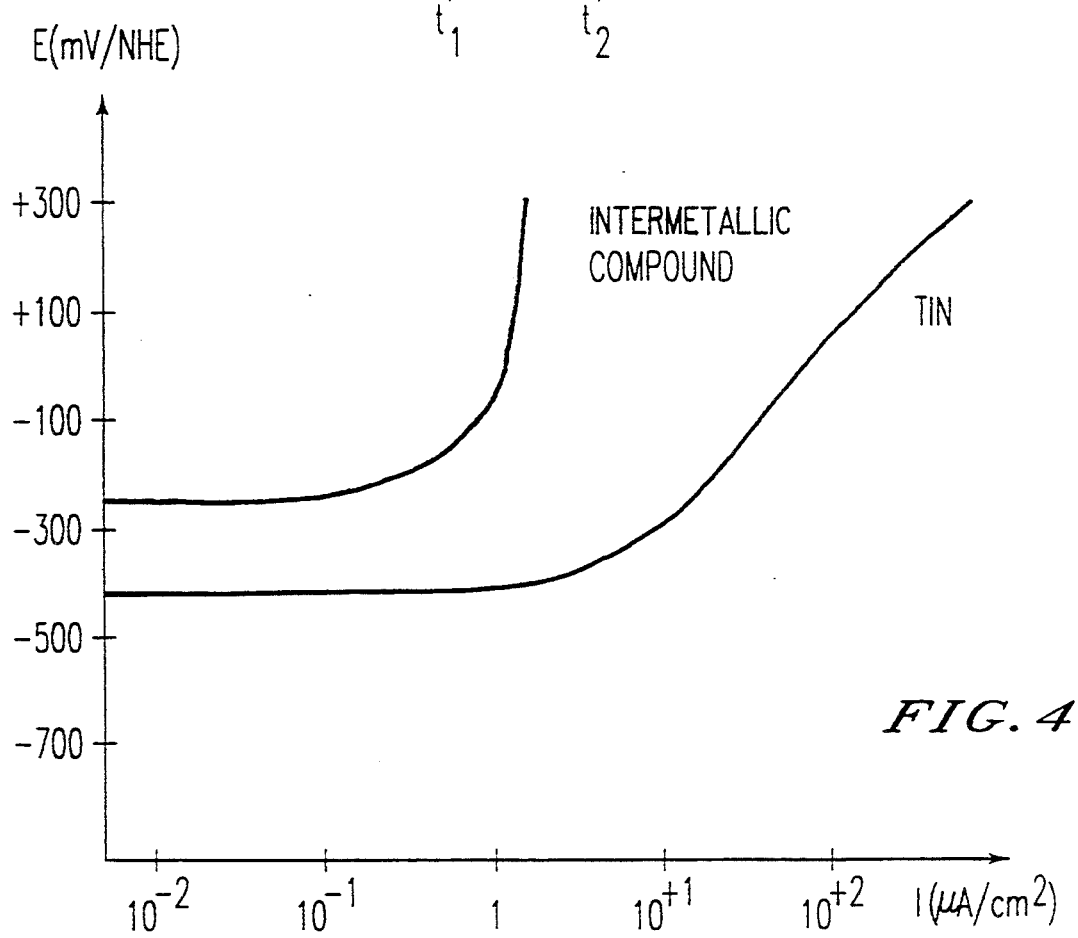
FIG. 4 is a diagram showing, on the one hand, the polarization curve of a sheet metal coated with a layer of tin and, on the other hand, the polarization curve of a sheet metal coated with the intermetallic compound containing iron, tin and chromium.

This high corrosion resistance of the intermetallic compound is illustrated in FIG. 4, which shows the plot of the curves of polarization of the intermetallic compound layer and of the tin layer which are placed in an aerated solution of sodium sulfate at a concentration of 0.01 mole/l, at ambient temperature. It is found that the current for dissolution of the intermetallic compound changes little as a function of the potential, this being characteristic of a high corrosion resistance. In contrast, tin, for which the dissolution current increases as a function of the applied potential appears to be less resistant to corrosion than the intermetallic compound.

The sheets comprising a layer of intermetallic compound exhibit good solderability.

A soldering test on a coated sheet metal of the type just described was carried out under the following conditions:

After pickling with phosphoric acid of the areas to be soldered, followed by overlapping over approximately 1 cm, the soldering was carried out using the iron and a Pb/Sn (33% Sn) rod. The soldering was tested by a bending test at 180° C. around a mandrel with a radius of curvature of 10 mm. No tearing away of the solder was found.

To form the layer of intermetallic compound the layer of pure tin may be replaced with a layer of alloy containing chiefly tin.

It is possible to employ an alloy of tin (Sn) and of zinc (Zn) the weight composition of which is the following:

$Sn > 60\%$ $Zn < 40\%$.

It is also possible to employ an alloy of tin (Sn) and nickel (Ni) the weight composition of which is the following:

$Sn > 80\%$ $Ni < 20\%$.

As in the case of pure tin, the alloy is deposited electrolytically on the stainless steel sheet. The alloy-coated sheet metal is then heated to a temperature higher than or equal to the melting temperature of the alloy, for a sufficient period for the alloy to retain its matt appearance.

The temperature of treatment of the coated sheet metal, after deposition of a layer of pure tin or of alloyed tin, is preferably lower than 500° C. in order to avoid the formation of a tin oxide of yellowish color, which is undesirable, at the surface of the coating.

The intermetallic compound which forms at the interface of the stainless steel sheet and of the layer of pure tin or of alloyed tin may contain compounds other than iron, tin and chromium, depending on the type of steel employed and of the type of alloy employed.

The coating of the sheet metal may be arranged at will on only one face of the sheet metal or on both faces of the sheet metal.

The invention incorporates numerous advantages.

The layer containing chiefly tin and deposited electrolytically on a stainless steel sheet exhibits an aesthetic matt appearance which is appreciable when the sheet metal is installed on the roof of a building.

The intermetallic compound containing iron, tin and chromium which appears at the surface of the sheet metal when the tin-based layer has disappeared has a matt appearance resembling that of "old tin" which is appreciated in the roofing of buildings.

The layer of intermetallic compound adheres strongly to the sheet metal and exhibits very good corrosion resistance.

The layer of intermetallic compound is stable under the influence of an acidic atmosphere or of a maritime climate.

Further, the sheet metal comprising a layer of intermetallic compound containing Fe, Sn and Cr exhibits very good solderability.

We claim:

1. A process for the manufacture of a coated stainless steel sheet useful in the manufacture of roofs of buildings, comprising the steps of:

providing a stainless steel sheet comprising more than 16% by weight of chromium;

pickling the steel sheet chemically or electrolytically by immersion in a bath comprising an inorganic acid;

rinsing the steel sheet;

activating the steel sheet chemically or electrolytically by immersion in a bath comprising phenolsulfonic acid, said bath having a pH lower than a depassivation pH of the stainless sheet;

depositing electrolytically on at least one face of the stainless sheet a coating layer of pure tin by means of an electrolytic deposition bath comprising stannous tin and phenolsulfonic acid.

2. The process according to claim 1, wherein the coated stainless steel sheet is heated to a temperature higher than or equal to the melting temperature of the tin coating layer in order to form a layer of an intermetallic compound between the steel sheet and the metallic coating, said compound comprising at least tin and an element forming part of the composition of the stainless steel sheet, and to impart a matte appearance to the surface of the coating.

3. The process according to claim 2, wherein the heating temperature is lower than 500° C.

4. The process according to claim 1, wherein the stainless steel sheet is degreased before pickling.

5. The process according to claim 4, wherein the steel sheet is degreased electrolytically by employing an alkaline electrolyte and by either alternating or not alternating polarities.

6. The process according to claim 5, wherein the electrolyte comprises an alkaline compound in a proportion of 0.5 to 20 mass %, the electrolyte being at a temperature of between 20° and 95° C., the steel sheet being subjected to a current density of between 0.1 and 20 A/dm$^2$ for a period longer than 0.1 s.

7. The process according to claim 5, wherein the electrolyte comprises an alkaline compound selected from the group consisting of sodium hydroxide and potassium hydroxide.

8. The process according to claim 7, wherein the electrolyte additionally comprises a compound selected from the group consisting of calcium carbonate, sodium metasilicate, phosphates, complexing agents and surface-active agents.

9. The process according to claim 1, wherein the stainless steel sheet is subjected to a neutral aqueous rinsing after it has been degreased.

10. The process according to claim 1, wherein chemical pickling is accomplished in a bath comprising 0.2 to 40 mass % hydrochloric acid, said bath being at a temperature of between 20° and 95° C., the immersion period of the sheet in the bath being longer than 0.1 s.

11. The process according to claim 1, wherein the electrolytic pickling bath contains 1 to 50 mass % of sulfuric acid and is at a temperature of between 20° and 95° C., the steel sheet being subjected to a current density of between 0.1 and 50 A/dm$^2$, a period of immersion of the sheet metal in the bath being longer than 0.1 s.

12. The process according to claim 11, wherein, while being pickled, the steel sheet is subjected either to an alternately cathodic and anodic polarization, the treatment being completed with cathodic polarization, or to a continuous cathodic polarization.

13. The process according to claim 1, wherein the bath for chemical pickling is at a temperature of more than 15° C. and a period of immersion of the sheet metal in the bath is longer than 0.1 s.

14. The process according to claim 1, wherein the activating electrolyte bath is at a temperature of more than 15° C. and the sheet metal is subjected to a cathodic polarization, with a current density of between 0.1 to 50 A/dm$^2$, a period of immersion of the sheet metal in the bath being longer than 0.1 s, the bath being in contact with anodes facing the sheet metal, the anodes being made of ferrosilicon alloy or of stainless steel.

15. The process according to claim 1, wherein the electrolytic deposition bath contains stannous tin in a proportion of from 20–40 g/l and phenolsulfonic acid in a proportion of from 20–40 g/l, current density being higher than 1 A/dm$^2$, the temperature of the bath being higher than 15° C.

16. The process of claim 1, consisting of the recited steps.

* * * * *